US007972161B2

(12) United States Patent
Rohde

(10) Patent No.: US 7,972,161 B2
(45) Date of Patent: Jul. 5, 2011

(54) CONNECTOR WITH FREE SPINNING NUT TO ENGAGE WITH PLUG HOUSING AND ANGLED HOUSING

(75) Inventor: Daniel F. Rohde, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 15 days.

(21) Appl. No.: 12/420,496

(22) Filed: Apr. 8, 2009

(65) Prior Publication Data

US 2010/0261388 A1 Oct. 14, 2010

(51) Int. Cl.
*H01R 13/62* (2006.01)

(52) U.S. Cl. ..... 439/320; 439/680

(58) Field of Classification Search ..... None
See application file for complete search history.

(56) References Cited

U.S. PATENT DOCUMENTS

| | | | | |
|---|---|---|---|---|
| 4,128,292 | A | 12/1978 | Mouttet | |
| 5,145,389 | A | 9/1992 | Okubo | |
| 5,197,894 | A | 3/1993 | Koike | |
| 5,620,334 | A | 4/1997 | Quillet et al. | |
| 5,833,484 | A | 11/1998 | Post et al. | |
| 5,895,291 | A | 4/1999 | Furio et al. | |
| RE37,265 | E | 7/2001 | Lwee | |
| 6,593,531 | B2 * | 7/2003 | Hulsmann et al. | 174/66 |
| 6,994,579 | B2 * | 2/2006 | Yokoigawa et al. | 439/320 |
| 7,304,241 | B2 * | 12/2007 | Trieb et al. | 174/74 R |
| 2002/0028607 | A1 * | 3/2002 | Babel et al. | 439/680 |
| 2004/0157499 | A1 * | 8/2004 | Nania et al. | 439/680 |
| 2005/0064752 | A1 * | 3/2005 | Serino | 439/320 |
| 2009/0269958 | A1 * | 10/2009 | Fujiwara et al. | 439/320 |

FOREIGN PATENT DOCUMENTS

JP 2001-267006 A 9/2001

OTHER PUBLICATIONS

Schematic drawing for Cable Clamp Kit, Unassembled, Right Angle, Size 11, CPC, Part Nos. 796379-1 and 796379-2, (Drawing C-796379), Rev. D, dated Nov. 2008.

Schematic drawing for Cable Clamp Kit, Unassembled, Right Angle, Size 13, CPC, Part Nos. 796380-1 and 796380-2, (Drawing C-796380), Rev. D, dated Nov. 2008.

Schematic drawing for Cable Clamp Kit, Unassembled, Right Angle, Size 17, CPC, Part Nos. 796381-1 and 796381-2, (Drawing C-796381), Rev. B, dated Nov. 2008.

Schematic drawing for Cable Clamp Kit, Unassembled, Right Angle, Size 23, CPC, Part Nos. 796382-1 and 796382-2, (Drawing C-796382), Rev. C, dated Nov. 2008.

Schematic drawing for Plug Assembly, Standard Sex, 13-7, CPC, Part No. 211399-1 (Drawing C-211399), Rev. D, dated Oct. 1997.

Schematic drawing for Assembly, Plug, Size 7, 1 Position, Sealed Mini CPC, Part No. 1445536-04 (Drawing C-1445536), Rev. B, dated Jun. 2004.

Catalog, "ODU MEDI-SNAP® Miniature Cylindrical Connectors with Push-Pull-Locking in Plastic," No. 1005ME-b-e, pp. 1-53, printed from www.odu-usa.com on Apr. 21, 2009.

(Continued)

*Primary Examiner* — Hien Vu

(57) ABSTRACT

A connector includes a plug housing configured to engage with a socket. A free spinning nut of the connector is disposed between the plug housing and an angled housing. The free spinning nut includes a first end portion configured to engage with the angled housing and a second end portion configured to engage with the plug housing.

21 Claims, 7 Drawing Sheets

OTHER PUBLICATIONS

Tyco Catalog, "Miniature Circular Plastic Connectors (CPC)," Rev. Apr. 2004, No. 109175, pp. 1-4.
Tyco Catalog 82021, "Miniature Circular Plastic Connectors (CPC)," Rev. Jul. 2006, pp. 71-74.
Tyco Catalog 82021, "CPC Connector Accessories," Rev. Jul. 2006, pp. 37-41.
Tyco Catalog 82021, "Circular Plastic Connector Sealing Accessories," Rev. Jul. 2007, pp. 52-88.
Tyco Brochure, "Miniature Circular Plastic Connector (CPC)," App. Spec. 114-13105, Sep. 16, 2003, pp. 1-13.
Tyco Catalog 82021, "Circular Plastic Connectors, Size 1," Rev. Jul. 2006, pp. 10-24.
Tyco Brochure, "AMP* Circular Plastic Connectors (CPC)," App. Spec. 114-10038, Mar. 15, 1990, pp. 1-11.
Tyco Catalog 82021, "AMP Circular Connectors for Commercial Signal & Power Applications," Rev. Jul. 2007, pp. 1-51.
International Search Report for International Application No. PCT/US2010/001049, mailed Jul. 13, 2010.

* cited by examiner

CONNECTOR WITH FREE SPINNING NUT TO ENGAGE WITH PLUG HOUSING AND ANGLED HOUSING

RELATED APPLICATION

This application is related to U.S. patent application Ser. No. 12/360,502 filed Jan. 27, 2009 and titled "Connector Receptacle with Molded Front Nut Gasket," the entirety of which is hereby incorporated by reference.

BACKGROUND

1. Technical Field

This application relates to connectors and, more particularly, to angled or curved connectors.

2. Related Art

Connectors may be used to join multiple devices. One type of connector is a plug that serves as an interface between a socket of a first device and a cable associated with a second device. The cable may carry electrical current, electrical signals, optical signals, fluid-based signals (e.g., fluidics), or other information between the first and second devices. In electrical-based connectors, one or more conductive paths of the cable may terminate to one or more electrical contacts in the plug. When the plug is inserted into the socket, the electrical contacts in the plug may interface with one or more electrical contacts in the socket to complete the connection between the first and second electrical devices.

In some implementations, the plug may be a right-angle plug. A first section of the right-angle plug interfaces with the socket of the first device. A second section of the right angle plug receives the cable. The first section and the second section of the plug may be shaped so that the plug forms a right angle. Therefore, the right-angle plug may create a transition from horizontal (e.g., the section connected with the socket) to vertical (e.g., the section connected with the cable). Some right-angle plugs have the shortcoming of requiring a complex assembly process. Therefore, a need exists for an improved connector for connecting a cable with a socket.

SUMMARY

A connector may join multiple devices. In one implementation, a connector includes a plug housing configured to engage with a socket. A free spinning nut of the connector is disposed between the plug housing and an angled housing. The free spinning nut includes a first end portion configured to engage with the angled housing and a second end portion configured to engage with the plug housing.

In another implementation, a connector is provided for connecting a cable with a socket. The connector includes a plug housing configured to engage with the socket. A contact component of the connector is configured to connect with one or more contacts of the socket. An angled housing of the connector defines a passageway for the cable to pass through at least a portion of the angled housing and connect with the contact component. The connector also includes means for mechanically connecting the plug housing and the angled housing. The means for mechanically connecting includes a first end portion configured to mate with the angled housing and a second end portion configured to mate with the plug housing.

In yet another implementation, a connector is provided for connecting a cable with a socket. The connector includes a plug housing configured to engage with the socket. A contact component of the connector is configured to connect with one or more contacts of the socket. A curved housing of the connector defines a passageway for the cable to pass through at least a portion of the curved housing and connect with the contact component. A keying component of the connector is configured to align one or more contact interfaces of the contact component relative to the curved housing and the plug housing. The connector also includes a free spinning nut disposed between the plug housing and the curved housing. The free spinning nut includes a first end portion configured to engage with the curved housing and a second end portion configured to engage with the plug housing.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION OF THE PREFERRED EMBODIMENTS

A connector may be used to connect multiple devices. For example, the connector may be a plug that serves as an interface between a socket of a first device and a cable associated with a second device. A first section of the connector engages with the socket of the first device. A second section of the connector receives the cable. The connector may be an assembly of multiple components. When the multiple components of the connector are assembled together, one or more contact interfaces in the connector may be properly aligned for connection with one or more corresponding contact interfaces in the socket.

Although the description herein describes aspects of an electrical connector (e.g., a connection between a socket and an electrical cable carrying electrical signals), the features described with reference to the electrical connector are also applicable to other types of connectors, such as optical connectors, fluidic connectors, or the like. In such implementations, the cable may include an optical path that carries optical signals, a fluid path that carries fluidic signals, or the like. A contact component of the connector that interfaces the cable with the socket may provide an electrical, optical, fluidic, or other interface between electrical, optical, fluidic, or other devices. Therefore, a contact in a connector or socket may provide an electrical interface, an optical interface, fluidic interface, or another type of interface.

Figure 1:
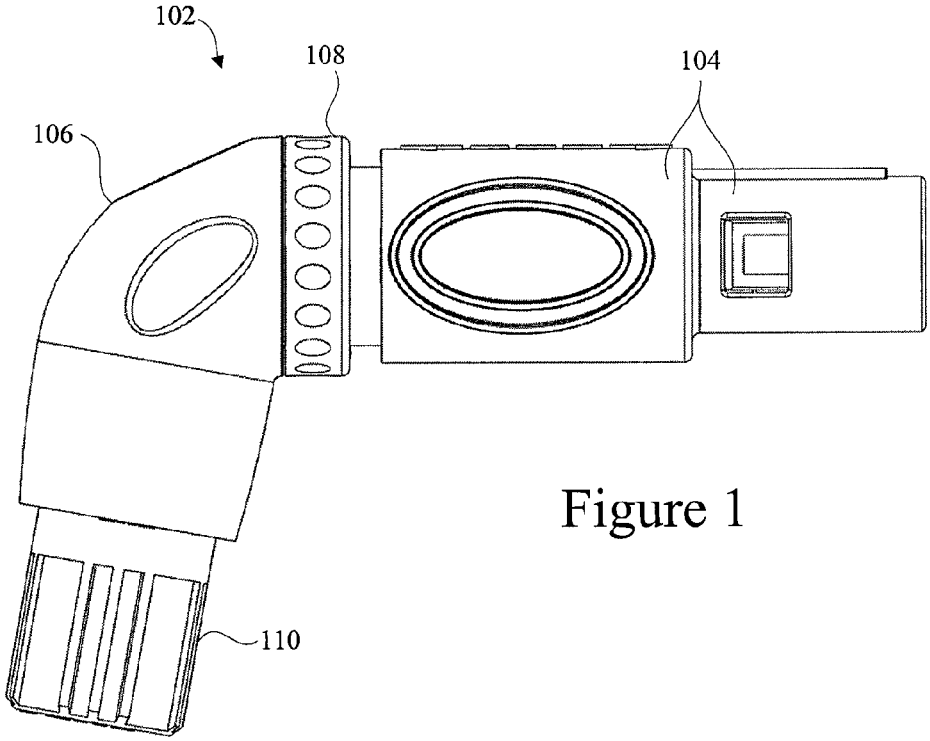
FIG. 1 illustrates an electrical connector.

FIG. 1 illustrates an electrical connector 102. The electrical connector 102 may include a plug housing 104, an angled housing 106, a free spinning nut 108, and a collet nut 110. An electrical cable may pass through the collet nut 110, through the angled housing 106, through the free spinning nut 108, and connect with a contact component. After the contact component is connected with the cable, the contact component may be drawn partially back into the angled housing 106 of the electrical connector 102. The contact component serves to electrically interface the cable with a socket of an electrical device (shown in FIGS. 7-9).

The plug housing 104 is configured to engage with a socket of an electrical device. In some implementations, the plug housing 104 may be sized to fit into an opening of the socket. In other implementations, the plug housing 104 may include an opening to receive a protuberance of the electrical device. In yet other implementations, the plug housing 104 is sized to fit within an opening of the socket and also includes an opening to receive a protuberance of the electrical device. One or more electrical contacts (e.g., the contact component) may be disposed within the plug housing 104 to connect with one or more electrical contacts in the socket to complete the electrical connection between the electrical connector 102 and the electrical device.

The angled housing 106 (e.g., curved housing) is configured to provide a change in direction for a cable that passes through the angled housing 106. In one implementation, the angled housing 106 forms a right angle or a substantially right angle. In another implementation, the angled housing 106 forms an obtuse angle. In yet another implementation, the angled housing 106 forms an acute angle.

The angled housing 106 may include a first substantially straight portion, a second substantially straight portion, and a curved portion that connects the first and second substantially straight portions. The curved portion may determine the degree of separation between the two substantially straight portions. In some implementations, the first substantially straight portion may be separated from the second substantially straight portion by an angle of about 90 degrees. In other implementations, the first substantially straight portion may be separated from the second substantially straight portion by an angle between about 80 degrees and about 100 degrees. In still other implementations, the first substantially straight portion may be separated from the second substantially straight portion by an angle between about 70 degrees and about 110 degrees. Other implementations may use different degrees of separation, such as less than 70 degrees or more than 110 degrees.

In some implementations, the angled housing 106 may provide a transition from substantially horizontal to substantially vertical. For example, if the plug housing 104 engages with a socket that is formed in a vertical surface of an electrical device, then the plug housing 104 will be substantially horizontal and the angled housing 106 may provide a transition to a substantially vertical passageway for the cable that connects with the electrical connector 102. In other implementations, the angled housing 106 may provide a transition from substantially vertical to substantially horizontal. For example, if the plug housing 104 engages with a socket that is formed in a horizontal surface of an electrical device, then the plug housing 104 will be substantially vertical and the angled housing 106 may provide a transition to a substantially horizontal passageway for the cable that connects with the electrical connector 102. In other implementations, the angled housing 106 may be configured to provide other transitions, such as from substantially horizontal in one direction to substantially horizontal in another direction.

The free spinning nut 108 serves to connect the plug housing 104 and the angled housing 106. A first end portion of the free spinning nut 108 is configured to engage with the angled housing 106 and a second end portion of the free spinning nut 108 is configured to engage with the plug housing 104. The free spinning nut 108 is configured to tighten a connection between the plug housing 104 and the angled housing 106 in response to a twisting motion applied to the free spinning nut 108 in a first direction. The free spinning nut 108 is configured to loosen the connection between the plug housing 104 and the angled housing 106 in response to a twisting motion applied to the free spinning nut 108 in a second direction. The free spinning nut 108 may be twisted relative to the plug housing 104 and the angled housing 106. The plug housing 104 may be positioned or keyed so that it is properly aligned with the angled housing 106. For example, the free spinning nut 108 may be twisted to tighten or loosen the connection between the plug housing 104 and the angled housing 106 while the plug housing 104 and the angled housing 106 remain in a keyed or aligned position relative to each other.

The components of the electrical connector 102 may be formed from metal, plastic, or the like. For example, the plug housing 104, the angled housing 106, the free spinning nut 108, and the collet nut 110 may be formed from a metal suitable for such connectors such as aluminum or die cast zinc, or a molded plastic such as a polyimide thermoplastic resin, ULTEM (available from Sabic Innovative Plastics, Niskayuna, N.Y.), polycarbonate, LEXAN (Sabic Innovative Plastics), or the like. In one implementation, at least some of the components (e.g., the free spinning nut 108 and/or the connector housings 104 and 106) may be formed from Polyphenylsulfone (PPSU). The electrical connector 102 may be a circular plastic connector (CPC) plug for connecting a cable and an electrical device. The electrical connector 102 may be used in medical, industrial, or other applications.

Figure 2:
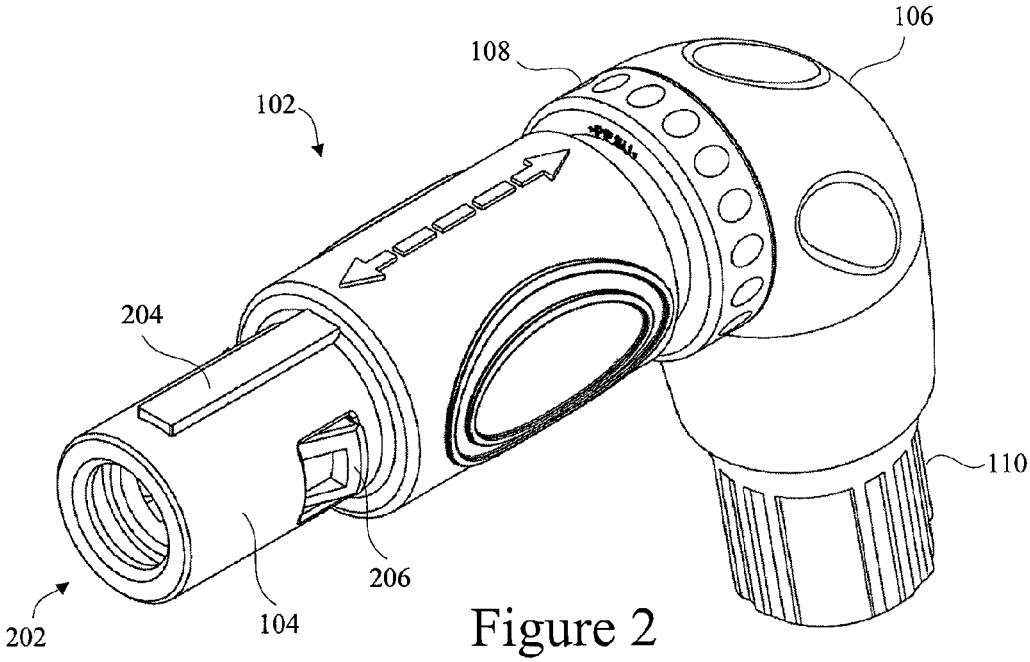
FIG. 2 illustrates an isometric view of the electrical connector of FIG. 1.

FIG. 2 illustrates an isometric view of the electrical connector 102 of FIG. 1. As shown in FIG. 2, the plug housing 104 may include one or more features to help align and connect the electrical connector 102 with a socket of an electrical device. For example, in FIG. 2, the plug housing 104 includes an opening 202, a keying component 204, and a latch 206. Other connection/alignment components may be used in other implementations. The opening 202 of the plug housing 104 allows one or more electrical contacts in the electrical connector 102 to connect with one or more electrical contacts in the socket to complete an electrical connection between the electrical connector 102 and the electrical device associated with the socket. The electrical contacts of the socket may pass into the opening 202 to meet the electrical contacts of the electrical connector 102.

The keying component 204 of the plug housing 104 serves to align the plug housing 104 (and therefore the rest of the electrical connector 102) with the socket. For example, the keying component 204 may be received by a corresponding keying component in the socket so that the contacts of the electrical connector 102 are aligned for connection with the contacts of the socket. The latch 206 of the plug housing 104 serves to hold the electrical connector 102 in the socket when the latch 206 is engaged with a corresponding feature of the socket.

Figure 3:
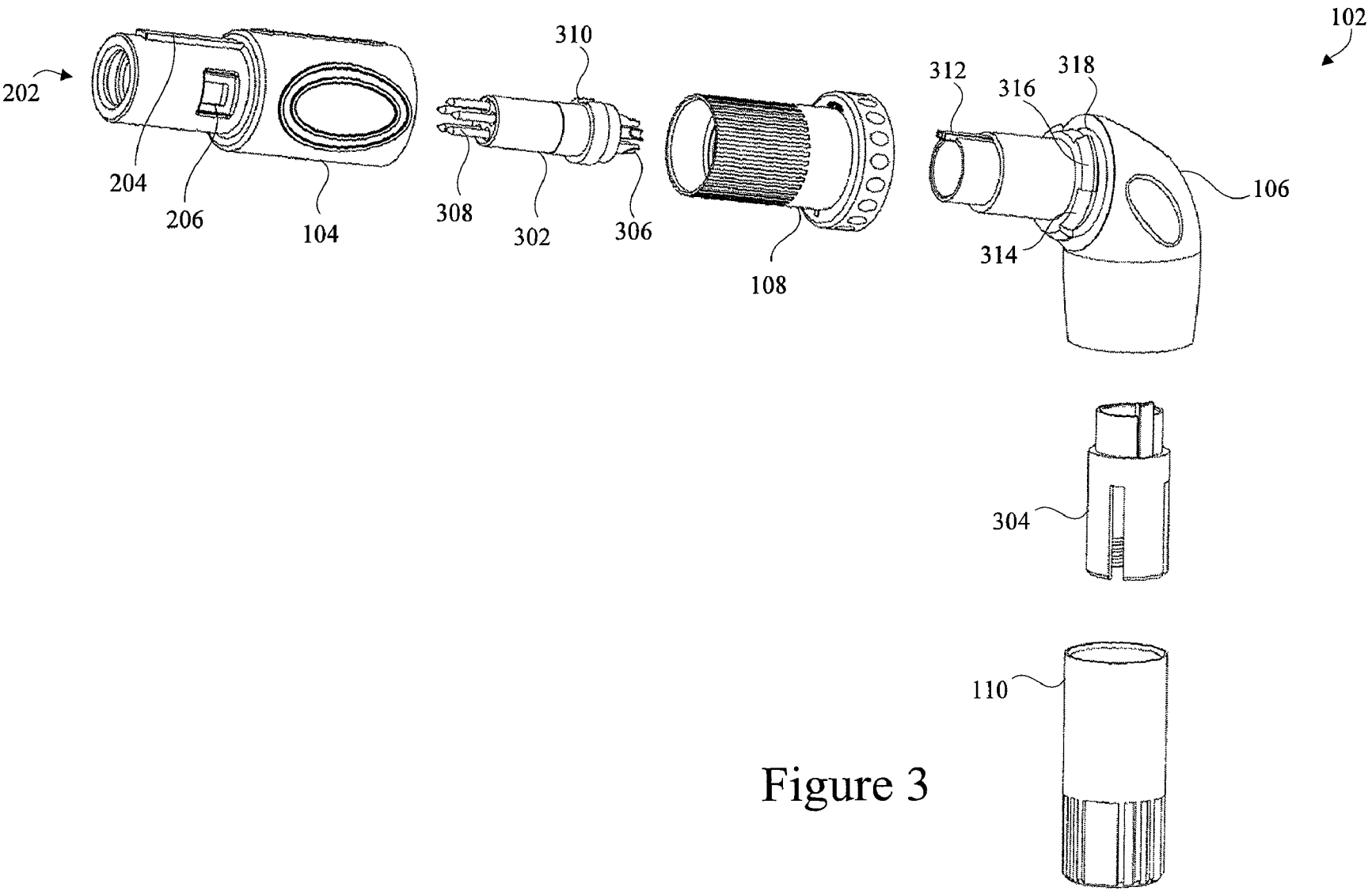
FIG. 3 illustrates an exploded view of the electrical connector of FIG. 1.

FIG. 3 illustrates an exploded view of the electrical connector 102 of FIG. 1. The exploded view of FIG. 3 shows the plug housing 104, the angled housing 106, the free spinning nut 108, and the collet nut 110. The exploded view of FIG. 3 also shows a contact component 302 and a cable collet 304 of the electrical connector 102. The cable collet 304 fits within the collet nut 110 and serves to provide strain and flex relief for the cable inserted into the electrical connector 102.

The contact component 302 serves as an electrical interface between the electrical connector 102 and the socket that receives the plug housing 104. For example, the contact component 302 may connect one or more electrical pathways of a cable with the electrical contacts of the socket. The angled housing 106 may define a passageway for the cable to pass through at least a portion of the angled housing 106 and connect with the contact component 302. The passageway of the angled housing 106 may cause the cable to change directions. For example, the cable may enter the angled housing 106 in a first direction, and then turn a corner within the angled housing 106 where it will connect with the contact component 302.

The contact component 302 may include one or more electrical contacts 306. The electrical pathways of the cable may terminate at the electrical contacts 306. For example, the electrical pathways of the cable may be soldered, crimped, or otherwise connected to the electrical contacts 306 of the contact component 302. The contact component 302 may also include one or more electrical contacts 308. The electrical contacts 308 serve to interface with one or more corresponding electrical contacts of the socket that receives the plug housing 104. For example, the electrical contacts 308 of the contact component 302 may be pins while the contacts of the socket may be corresponding openings. Alternatively, the electrical contacts 308 of the contact component 302 may be openings while the contacts of the socket may be corresponding pins.

The contact component 302 may also include a keying component 310. The keying component 310 serves to engage with a keying component 312 of the angled housing 106. When the keying component 310 is engaged with the keying component 312, the contact component 302 may be properly aligned relative to the angled housing 106.

In FIG. 3, the keying component 312 is shown as a tab and the keying component 310 is shown as a slot sized to receive the tab. In other implementations, the keying component 310 may be a tab while the keying component 312 may be a slot sized to receive the tab. Alternatively, other mechanisms for aligning the contact component 302 relative to the angled housing 106 may be employed.

The plug housing 104 may include a keying component (not shown) that is configured to align the contact component 302 and the angled housing 106 relative to the plug housing 104. For example, the plug housing 104 may include a slot on its inner surface to receive a top portion of the keying component 312. Therefore, the bottom portion of the keying component 312 would engage with the keying component 310 of the contact component 302 while the top portion of the keying component 312 would engage with the keying component of the plug housing 104. When the keying components are all engaged, then the plug housing 104, the angled housing 106, and the contact component 302 may all be aligned relative to each other. The keying components serve to position the contact interfaces of the contact component 302 for connection with the contact interfaces of the socket that receives the plug housing 104. For example, the contacts of the socket may be positioned to require a specific configuration/orientation of the contacts of the contact component 302. By keying the component pieces together based on the connection between the plug housing 104 and the socket, the contacts of the contact component 302 may be oriented for proper connection with the contacts of the socket.

FIG. 3 also shows an implementation of the angled housing 106 that may include one or more ramps 314, one or more tabs 316, and a channel 318. These features may be used to connect the angled housing 106 and the free spinning nut 108, and will be discussed below in connection with FIG. 5.

Figure 4:
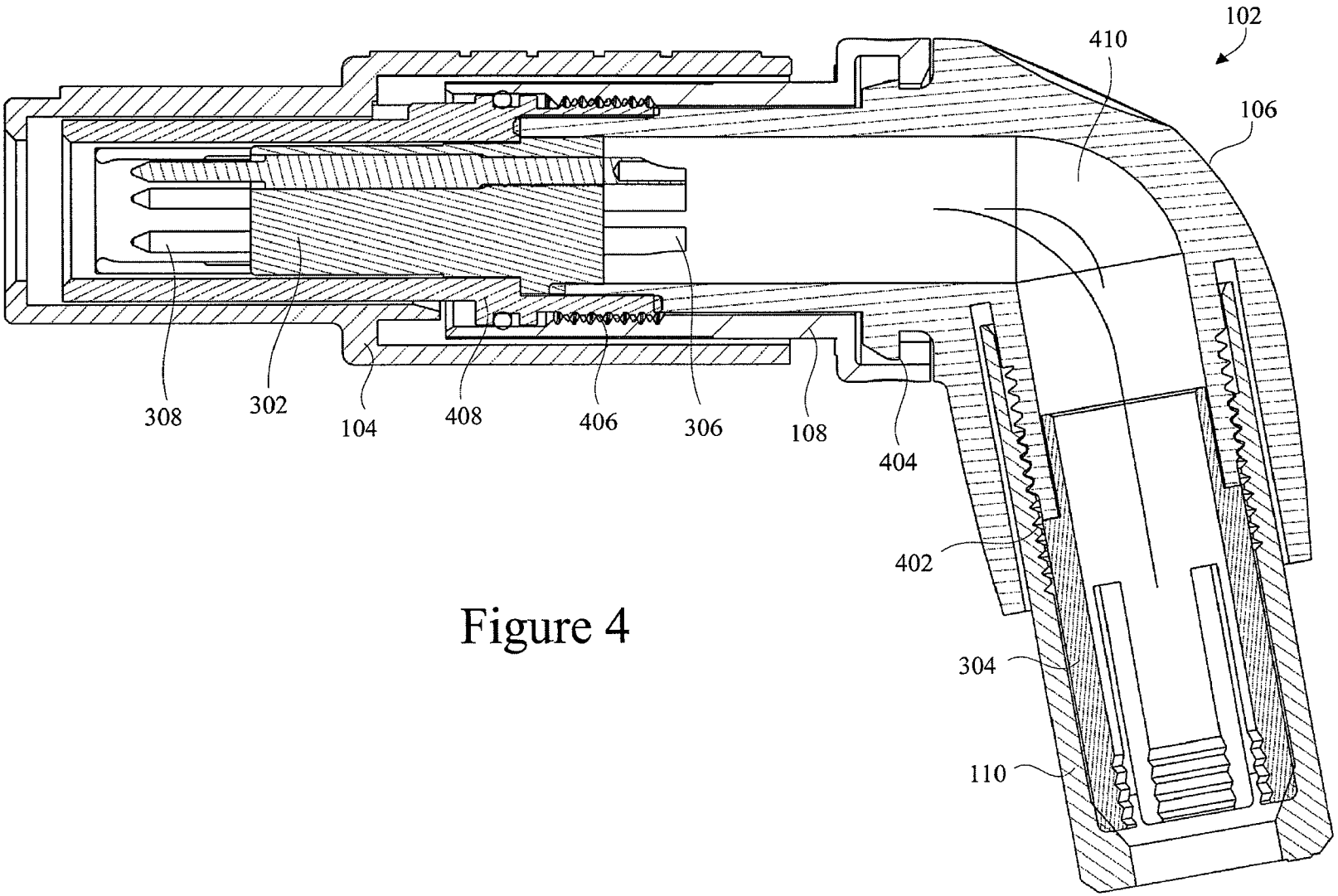
FIG. 4 illustrates a cross-sectional view of the electrical connector of FIG. 1.

FIG. 4 illustrates a cross-sectional view of the electrical connector 102 of FIG. 1. The cross-sectional view shows the connections of multiple components of the electrical connector 102 to form an assembly. The cable collet 304 is shown disposed within the collet nut 110. The collet nut 110 may form a threaded connection 402 with the angled housing 106. In other implementations, a snap-fit or other connection type may be used. The angled housing 106 may form a snap-fit connection 404 with the free spinning nut 108. The other end portion of the free spinning nut 108 may form a threaded connection 406 with the plug housing 104. The threaded connection 406 may be between the free spinning nut 108 and the plug housing 104 directly. Alternatively, the threaded connection 406 may be between the free spinning nut 108 and an inner lining 408 of the plug housing 104. The contact component 302 is shown disposed within a cavity formed by the plug housing 104 and the angled housing 106. In FIG. 4, the inner lining 408 of the plug housing 104 holds the contact component 302 in place. FIG. 4 also shows an inner passageway 410 that travels through the angled housing 106. The passageway 410 provides an angled, bent, or curved path for the cable to traverse from the opening in the collet nut 110 to termination at the electrical contacts 306 of the contact component 302.

Figure 5:
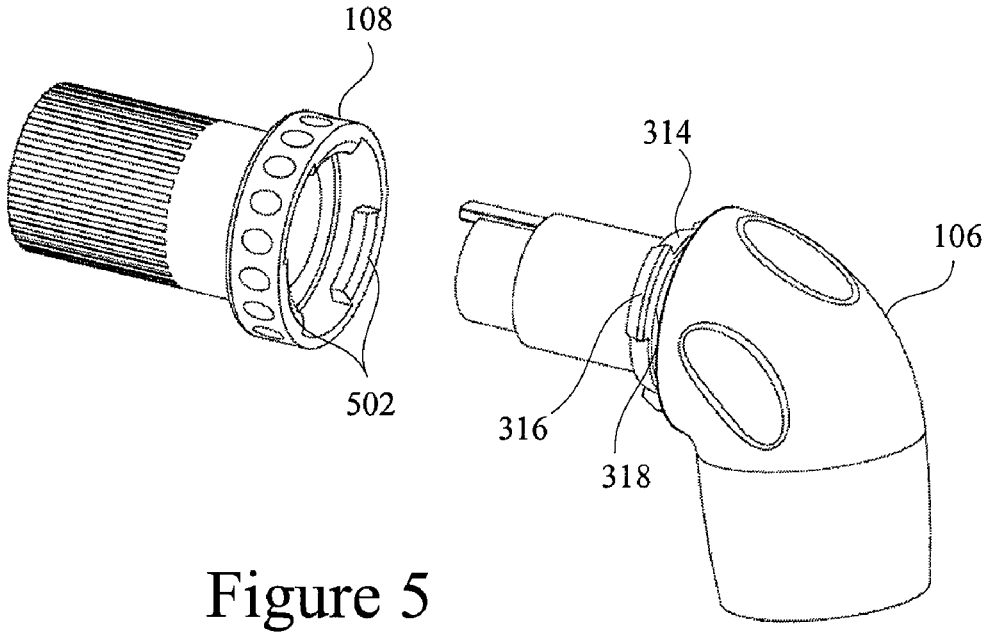
FIG. 5 illustrates a free spinning nut and an angled housing of an electrical connector.

FIG. 5 illustrates the free spinning nut 108 and the angled housing 106 of an electrical connector. The free spinning nut 108 may include one or more teeth 502. The angled housing 106 may include one or more ramps 314, one or more tabs 316, and a channel 318 (as shown in FIG. 3). When connecting the free spinning nut 108 with the angled housing 106, the teeth 502 of the free spinning nut 108 ride up and over the ramp 314 and into the channel 318. Therefore, the free spinning nut 108 may be snap fit together with the angled housing 106. The teeth 502 may be engaged with the channel 318 when the teeth 502 align with the openings between the tabs 316 of the angled housing 106. The tabs 316 of the angled housing 106 may help hold the teeth 502 of the free spinning nut 108 in the channel 318 when the teeth are engaged with the channel 502 and are at least partially aligned with the tabs 316.

The teeth 502 of the free spinning nut 108 may ride along the channel 318 of the angled housing 106 when the free spinning nut 108 is being twisted to form the threaded connection 406 (FIG. 4) with the plug housing 104. Therefore, the free spinning nut 108 may tighten a connection between the plug housing 104 and the angled housing 106 without changing the relative orientation of the plug housing 104 and the angled housing 106. For example, the plug housing 104 may be keyed, directly or indirectly, to the angled housing 106 while the free spinning nut 108 is twisted to tighten the connection between the plug housing 104 and the angled housing 106. One end portion of the free spinning nut 108 may be used to make the threaded connection with the plug housing 104 while the other end portion of the free spinning nut 108 may travel around a snap-fit connection with the angled housing 106.

Figure 6:
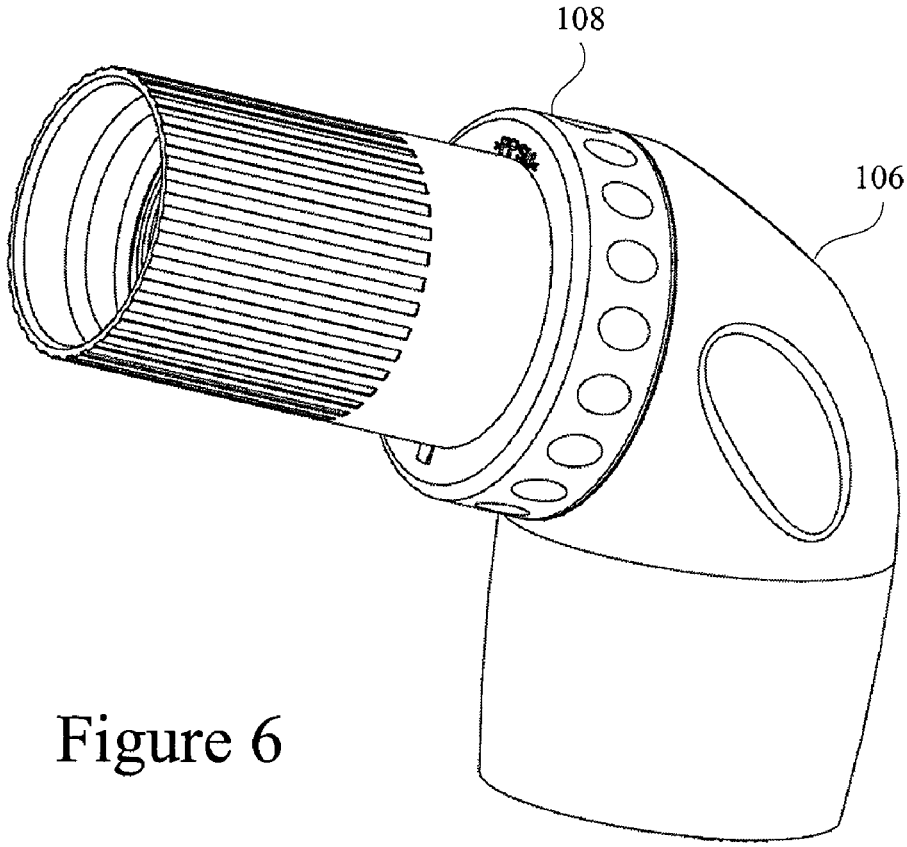
FIG. 6 illustrates a connection between the free spinning nut and the angled housing of FIG. 5.

FIG. 6 illustrates a completed connection between the free spinning nut 108 and the angled housing 106. For example, the teeth 502 (FIG. 5) of the free spinning nut 108 have passed over the ramp 314 to engage with the channel 318 of the angled housing 106. Alternatively, different connection techniques may be used. In some implementations, a ridge of the free spinning nut 108 may be received by a channel of the angled housing 106. In other implementations, a ridge of the angled housing 106 may be received by a channel of the free spinning nut 108.

Figure 7:
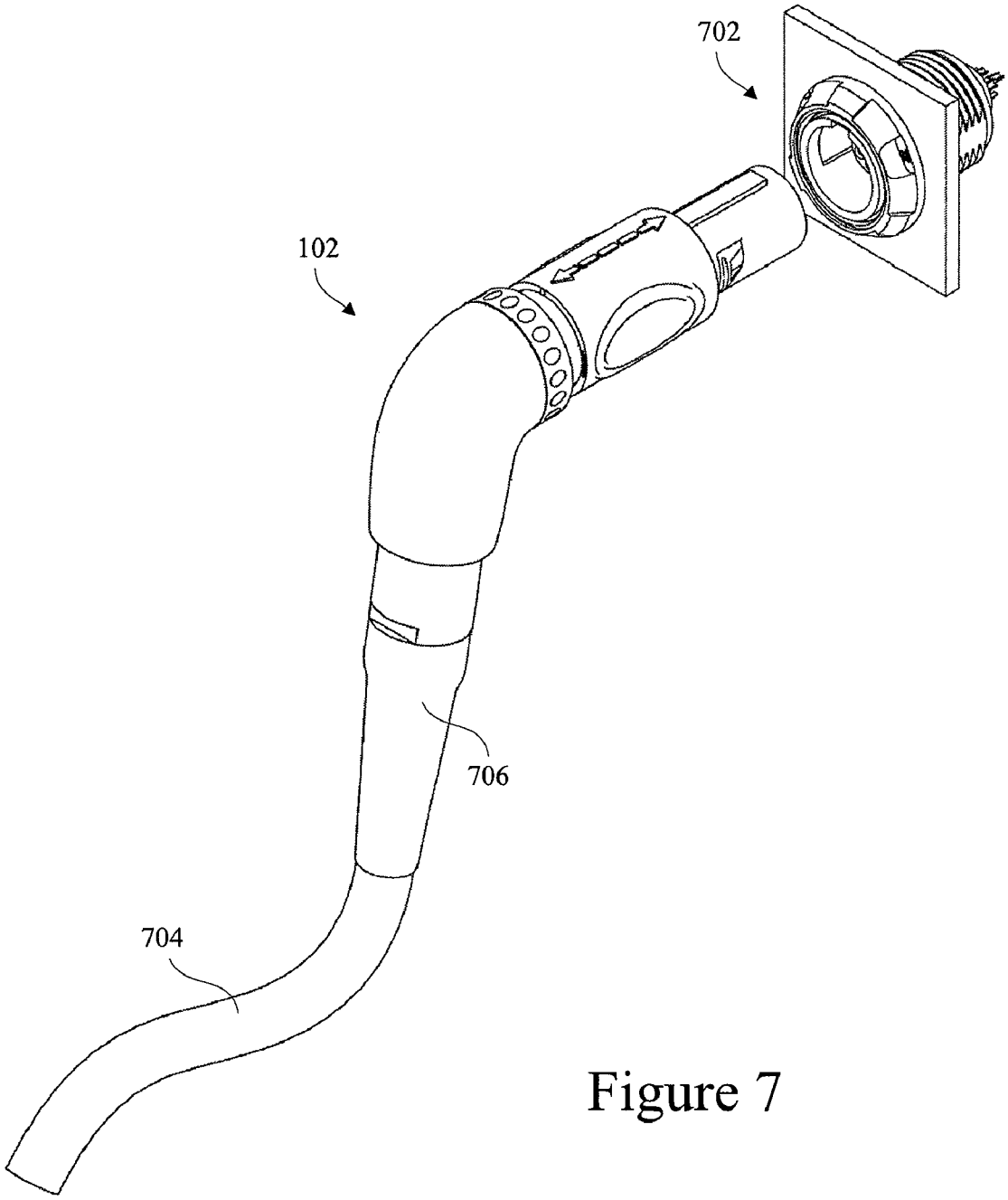
FIG. 7 illustrates a socket and an electrical connector.
Figure 8:
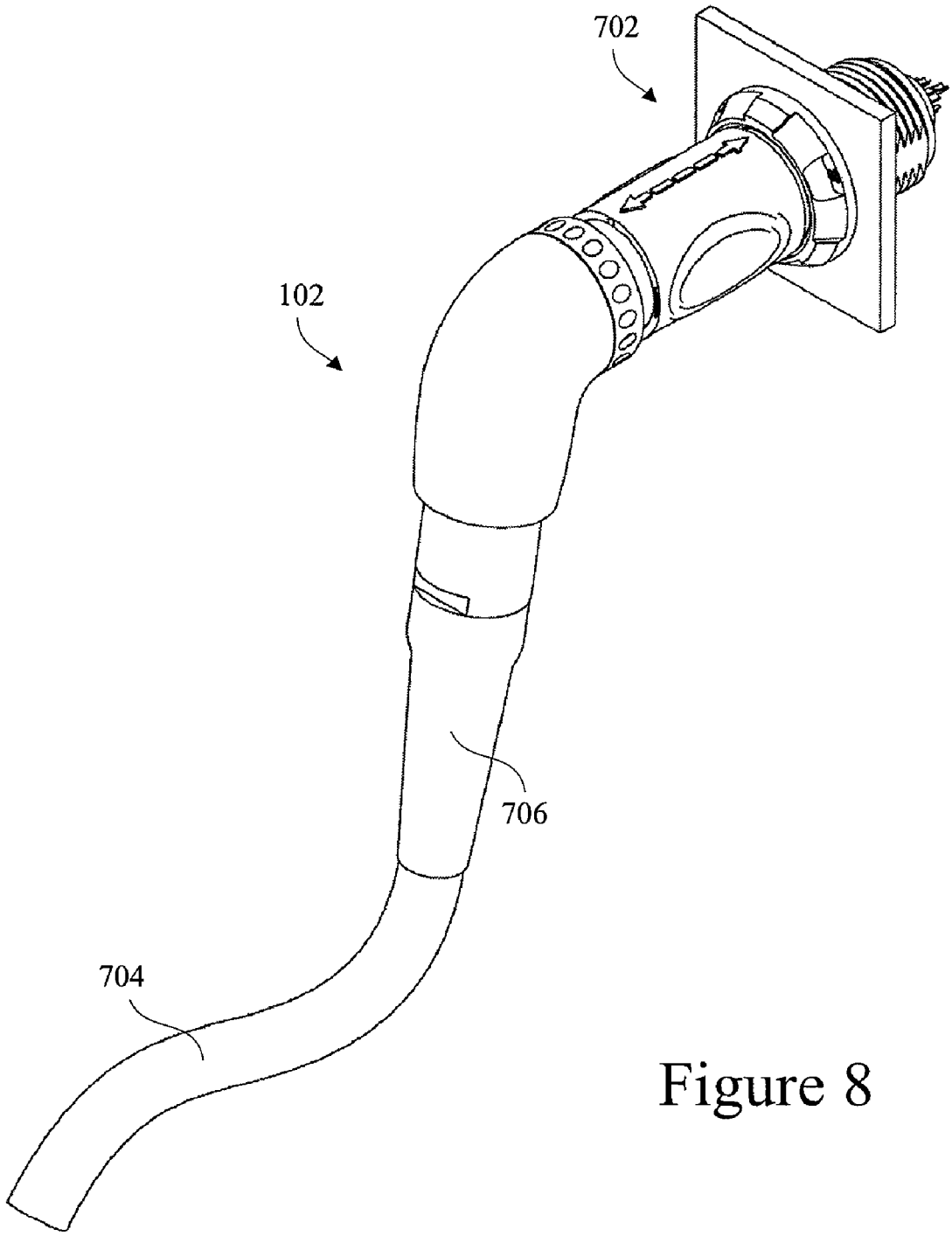
FIG. 8 illustrates a connection between the socket and the electrical connector of FIG. 7.

FIG. 7 illustrates the electrical connector 102 and a socket 702 (e.g., a receptacle). The electrical connector 102 is connected with an electrical cable 704. The cable 704 passes through a housing of the electrical connector to terminate at a contact component (such as the contact component 302 of FIG. 3). A cable restraint component 706 may help hold the cable 704 in the electrical connector 102 and provide strain and flex relief for the cable 704. FIG. 8 illustrates a connection between the electrical connector 102 and the socket 702. For example, the plug housing of the electrical connector 102 may include one or more features to engage with the socket 702 and/or one or more features to align the electrical connector 102 relative to the socket 702 when the electrical connector 102 engages with the socket 702.

Figure 9:
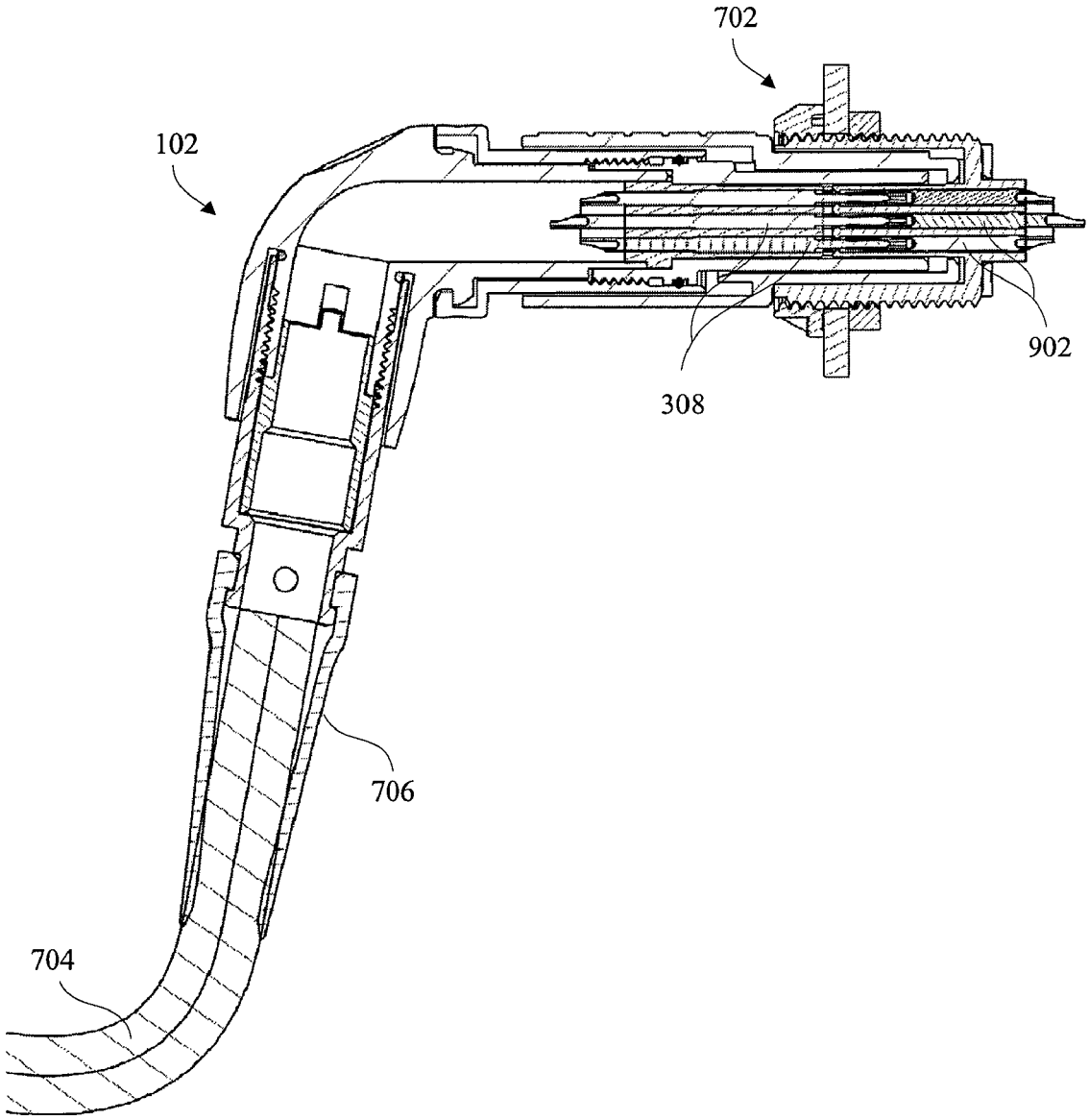
FIG. 9 illustrates a cross-sectional view of the connection between the socket and the electrical connector of FIG. 8.

FIG. 9 illustrates a cross-sectional view of the connection between the electrical connector 102 and the socket 702 of FIG. 8. In FIG. 9, the one or more electrical contacts 308 (e.g., pins) of the electrical connector 102 are received by one or more corresponding slots 902 of the socket 702. Alternatively, the electrical contacts 308 of the electrical connector may be slots that are configured to receive corresponding pins of the socket 702. The connection of the multiple components of the electrical connector 102 may be keyed or aligned so that the orientation of the electrical contacts 308 of the electrical connector 102 are properly positioned for connection with the corresponding pins or slots of the socket.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A connector, comprising:

a plug housing configured to engage with a socket;

an angled housing configured to provide a change in direction for a cable that passes through the angled housing; and a spinning nut disposed between the plug housing and the angled housing, wherein the spinning nut comprises a first end portion configured to engage with the angled housing and a second end portion configured to engage with the plug housing, the plug housing and the angled housing held in a fixed position by the spinning nut;

wherein the first end portion of the free spinning nut is configured to snap fit with the angled housing; and wherein the second end portion of the free spinning nut is configured to form a threaded connection with the plug housing.

2. The connector of claim 1, wherein the angled housing forms a right angle or a substantially right angle.

3. The connector of claim 1, wherein the angled housing forms an obtuse angle.

4. The connector of claim 1, wherein the angled housing comprises a first substantially straight portion, a second substantially straight portion, and a curved portion that connects the first and second substantially straight portions; and wherein the first substantially straight portion is separated from the second substantially straight portion by an angle between about 70 degrees and about 110 degrees.

5. The connector of claim 1, further comprising a contact component configured to connect with one or more contacts of the socket, wherein the contact component is configured to connect with one or more signal paths of a cable that passes through at least a portion of the angled housing.

6. The connector of claim 1, wherein the socket comprises an electrical device and the connector comprises a circular plastic connector plug for connecting the cable and the electrical device.

7. A connector, comprising:

a plug housing configured to engage with a socket;

an angled housing configured to provide a change in direction for a cable that passes through the angled housing; and a spinning nut disposed between the plug housing and the angled housing, the spinning nut comprising a first end portion configured to engage with the angled housing by a snap fit and a second end portion configured to engage with the plug housing by a threaded connection, the plug housing and the angled housing held in a fixed position by the spinning nut, the spinning nut being configured to tighten a connection between the plug housing and the angled housing in response to a twisting motion applied to the spinning nut in a first direction, and the spinning nut being configured to loosen the connection between the plug housing and the angled housing in response to a twisting motion applied to the spinning nut in a second direction.

8. A connector, comprising:

a plug housing configured to engage with a socket;

an angled housing configured to provide a change in direction for a cable that passes through the angled housing and comprising a ramp and a channel; and a spinning nut disposed between the plug housing and the angled housing, the spinning nut comprising a first end portion configured to engage with the angled housing by a snap fit and a second end portion configured to engage with the plug housing, the first end portion of the spinning nut comprising one or more teeth, the one or more teeth riding up and over the ramp and into the channel when the spinning nut is snap fit together with the angled housing, the plug housing and the angled housing held in a fixed position by the spinning nut.

9. The connector of claim 8, wherein the one or more teeth of the spinning nut are free to ride along the channel of the angled housing when the spinning nut is being twisted to form a threaded connection with the plug housing.

10. A connector, comprising:

a plug housing configured to engage with a socket;

an angled housing configured to provide a change in direction for a cable that passes through the angled housing;

a spinning nut disposed between the plug housing and the angled housing; and a contact component configured to connect with one or more contacts of the socket, the spinning nut comprising a first end portion configured to snap fit and engage with the angled housing and a second end portion configured to engage with the plug housing, the angled housing comprising a first keying component, and the contact component comprising comprises a second keying component configured to align the contact component relative to the angled housing when the first keying component is engaged with the second keying component, the plug housing and the angled housing held in a fixed position by the spinning nut.

11. The connector of claim 10, wherein the first keying component comprises a tab, and wherein the second keying component comprises a slot sized to receive the tab.

12. The connector of claim 10, wherein the second keying component comprises a tab, and wherein the first keying component comprises a slot sized to receive the tab.

13. The connector of claim 10, wherein the plug housing comprises a third keying component configured to align the contact component and the angled housing relative to the plug housing.

14. The connector of claim 13, wherein the plug housing comprises a fourth keying component that is configured to align the plug housing relative to the socket, and wherein the third and fourth keying components are configured to align multiple contact interfaces of the contact component for connection with multiple contact interfaces of the socket.

15. A connector for connecting a cable with a socket, comprising:

a plug housing configured to engage with the socket;

a contact component configured to connect with one or more contacts of the socket;

an angled housing that defines a passageway for the cable to pass through at least a portion of the angled housing and connect with the contact component; and means for mechanically connecting the plug housing and the angled housing, wherein the means for mechanically connecting comprises a first end portion configured to mate with the angled housing and a second end portion configured to mate with the plug housing, the plug housing and the angled housing being held in a fixed position by the means for mechanically connecting the plug housing and the angled housing;

wherein the means for mechanically connecting forms a threaded connection with the plug housing and snap fits with the angled housing.

16. The connector of claim 15, wherein the angled housing comprises a first substantially straight portion, a second substantially straight portion, and a curved portion that connects the first and second substantially straight portions; and wherein the first substantially straight portion is separated from the second substantially straight portion by an angle between about 70 degrees and about 110 degrees.

17. The connector of claim 15, wherein the contact component comprises multiple contact interfaces, the connector further comprising:

means for keying the contact component with the angled housing and the plug housing to align the multiple contact interfaces for connection with multiple contact interfaces of the socket.

18. A connector for connecting a cable with a socket, comprising:

a plug housing configured to engage with the socket;

a contact component configured to connect with one or more contacts of the socket;

an angled housing that defines a passageway for the cable to pass through at least a portion of the angled housing and connect with the contact component; and means for mechanically connecting the plug housing and the angled housing, the means for mechanically connecting (a) comprising a first end portion configured to mate with the angled housing and a second end portion configured to mate with the plug housing, (b) forming a threaded connection with the plug housing and snap fits with the angled housing, (c) configured to tighten a connection between the plug housing and the angled housing in response to a twisting motion applied in a first direction to the means for mechanically connecting, and (d) configured to loosen the connection between the plug housing and the angled housing in response to a twisting motion applied in a second direction to the means for mechanically connecting.

19. A connector for connecting a cable with a socket, comprising:

a plug housing configured to engage with the socket;

a contact component configured to connect with one or more contacts of the socket;

a curved housing that defines a passageway for the cable to pass through at least a portion of the curved housing and connect with the contact component;

a keying component configured to align one or more contact interfaces of the contact component relative to the curved housing and the plug housing; and a spinning nut disposed between the plug housing and the curved housing, wherein the free spinning nut comprises a first end portion configured to snap fit and engage with the curved housing and a second end portion configured to engage with the plug housing, the plug housing and the curved housing held in a fixed position by the spinning nut;

wherein the first end portion of the spinning nut is configured to snap fit with the curved housing, wherein the second end portion of the spinning nut is configured to form a threaded connection with the plug housing.

20. The connector of claim 19, wherein the spinning nut is configured to tighten a connection between the plug housing and the curved housing in response to a twisting motion applied to the spinning nut in a first direction; and wherein the spinning nut is configured to loosen the connection between the plug housing and the curved housing in response to a twisting motion applied to the spinning nut in a second direction.

21. A connector for connecting a cable with a socket, comprising a plug housing configured to engage with the socket;

a contact component configured to connect with one or more contacts of the socket;

a curved housing that defines a passageway for the cable to pass through at least a portion of the curved housing and connect with the contact component, the curved housing comprising a first substantially straight portion, a second substantially straight portion, and a curved portion that connects the first and second substantially straight portions, and the first substantially straight portion being separated from the second substantially straight portion by an angle between about 70 degrees and about 110 degrees;

a keying component configured to align one or more contact interfaces of the contact component relative to the curved housing and the plug housing; and a spinning nut disposed between the plug housing and the curved housing, the free spinning nut comprising a first end portion configured to snap fit and engage with the curved housing and a second end portion configured to engage with the plug housing.

* * * * *